US012139797B2

(12) United States Patent
Tsuji et al.

(10) Patent No.: US 12,139,797 B2
(45) Date of Patent: Nov. 12, 2024

(54) ACID SOLUTION PREPARATION DEVICE, ACID SOLUTION SUPPLY APPARATUS, AND PICKLING FACILITY

(71) Applicant: PRIMETALS TECHNOLOGIES JAPAN, LTD., Hiroshima (JP)

(72) Inventors: Kosei Tsuji, Hiroshima (JP); Ryusuke Nakatsuka, Hiroshima (JP); Takahiro Yagi, Hiroshima (JP); Masashi Yoshikawa, Tokyo (JP); Hideaki Takatani, Tokyo (JP); Toyoaki Yasui, Tokyo (JP); Takuya Hirata, Tokyo (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 591 days.

(21) Appl. No.: 17/439,720

(22) PCT Filed: Mar. 22, 2019

(86) PCT No.: PCT/JP2019/012129
§ 371 (c)(1),
(2) Date: Sep. 15, 2021

(87) PCT Pub. No.: WO2020/194384
PCT Pub. Date: Oct. 1, 2020

(65) Prior Publication Data

US 2022/0154351 A1 May 19, 2022

(51) Int. Cl.

| | |
|---|---|
| ***C23G 3/02*** | (2006.01) |
| ***C23G 1/08*** | (2006.01) |
| *C23G 1/36* | (2006.01) |

(52) U.S. Cl.
CPC ..... *C23G 3/025* (2013.01); *C23G 1/08* (2013.01); *C23G 1/081* (2013.01); *C23G 1/085* (2013.01);
(Continued)

(58) Field of Classification Search
CPC ..... C23G 3/021; C23G 1/08; C23G 1/085; C23G 3/025; C23G 1/36; C23G 1/086; C23G 1/081
See application file for complete search history.

(56) References Cited

U.S. PATENT DOCUMENTS 2,838,376 A * 6/1958 Allen, Jr. ..... C01B 17/901 423/DIG. 1
3,928,529 A * 12/1975 Grulke ..... C01G 49/06 423/481
(Continued)

FOREIGN PATENT DOCUMENTS

CN 202212092 U 5/2012
EP 795628 A1 * 9/1997 ..... C23G 1/36
(Continued)

OTHER PUBLICATIONS

Machine Translation of Abstract of JP 01-165783 A to Nagaya. (Year: 1989).*
(Continued)

*Primary Examiner* — Benjamin L Osterhout
(74) *Attorney, Agent, or Firm* — Birch, Stewart, Kolasch & Birch, LLP

(57) ABSTRACT

An acid solution preparation device is an acid solution preparation device for preparing an acid solution used for pickling of a steel plate, the device including a sealed tank for storing the acid solution, a gas supply part for supplying an oxygen-containing gas from outside of the sealed tank to the sealed tank, and a purge part for discharging a gas in the sealed tank to the outside.

19 Claims, 10 Drawing Sheets

(52) U.S. Cl.
CPC ..... *C23G 1/086* (2013.01); *C23G 1/36* (2013.01); *C23G 3/021* (2013.01)

(56) References Cited

U.S. PATENT DOCUMENTS

| | | | | | |
|---|---|---|---|---|---|
| 4,166,098 | A * | 8/1979 | Watanabe | C01G 49/06 | 423/139 |
| 5,232,490 | A * | 8/1993 | Bender | C22B 3/10 | 423/40 |
| 5,851,304 | A | 12/1998 | Giraud et al. | | |
| 5,958,147 | A * | 9/1999 | Berglind | C23G 1/103 | 510/109 |
| 5,992,196 | A | 11/1999 | Giraud et al. | | |
| 6,250,314 | B1 | 6/2001 | Wasserbauer et al. | | |
| 6,746,614 | B2 * | 6/2004 | Madi | C23G 1/36 | 423/DIG. 1 |
| 2003/0211031 | A1 | 11/2003 | Temyanko | | |

FOREIGN PATENT DOCUMENTS

| | | | | |
|---|---|---|---|---|
| EP | 0 795 628 | B1 | 5/2001 | |
| JP | 01165783 | A * | 6/1989 | C23G 1/086 |
| JP | 2000-44250 | A | 2/2000 | |
| JP | 4186131 | B2 | 11/2008 | |

OTHER PUBLICATIONS

Extended European Search Report dated Feb. 15, 2022, issued to the corresponding European Application No. 19921211.9.
Office Action dated Nov. 15, 2022 issued in counterpart Chinese Application No. 201980089801.0 with an English Translation.

* cited by examiner

ACID SOLUTION PREPARATION DEVICE, ACID SOLUTION SUPPLY APPARATUS, AND PICKLING FACILITY

TECHNICAL FIELD

The present disclosure relates to an acid solution preparation device, an acid solution supply apparatus, and a pickling facility.

BACKGROUND

It is known that, in pickling a steel plate, a pickling speed is increased by regulating a concentration of ferric ions ($Fe^{3+}$) contained in an acid solution, and a method for regulating the $Fe^{3+}$ concentration in the acid solution is proposed.

For example, Patent Document 1 describes, in order to maintain a concentration of $Fe^{3+}$ contained in an acid solution within a predetermined range, aerating the acid solution, oxidizing ferrous ions ($Fe^{2+}$) generated in the acid solution in pickling, and increasing the $Fe^{3+}$ concentration in the acid solution.

CITATION LIST

Patent Literature

Patent Document 1: JP4186131B

SUMMARY

Technical Problem

However, in the aeration described in Patent Document 1, it is difficult to increase a dissolved oxygen concentration in the acid solution, and it is difficult to sufficiently increase an oxidation reaction rate of iron ions. Moreover, large quantities of acid solution are needed to obtain a sufficient amount of $Fe^{3+}$ ions by oxidation reaction of iron ions, requiring a huge acid solution tank. Therefore, it is difficult to actually adopt an oxidation treatment of iron ions in the acid solution by aeration.

In view of the above, an object of at least one embodiment of the present invention is to provide an acid solution preparation device, an acid solution supply apparatus, and a pickling facility capable of easily regulating a $Fe^{3+}$ concentration in an acid solution used for pickling of a steel plate.

Solution to Problem

An acid solution preparation device according to at least one embodiment of the present invention is an acid solution preparation device for preparing an acid solution used for pickling of a steel plate, the device including a sealed tank for storing the acid solution, a gas supply part for supplying an oxygen-containing gas from outside of the sealed tank to the sealed tank, and a purge part for discharging a gas in the sealed tank to the outside.

Advantageous Effects

According to at least one embodiment of the present invention, provided are an acid solution preparation device, an acid solution supply apparatus, and a pickling facility capable of easily regulating a $Fe^{3+}$ concentration in an acid solution used for pickling of a steel plate.

DETAILED DESCRIPTION

Figure 1:
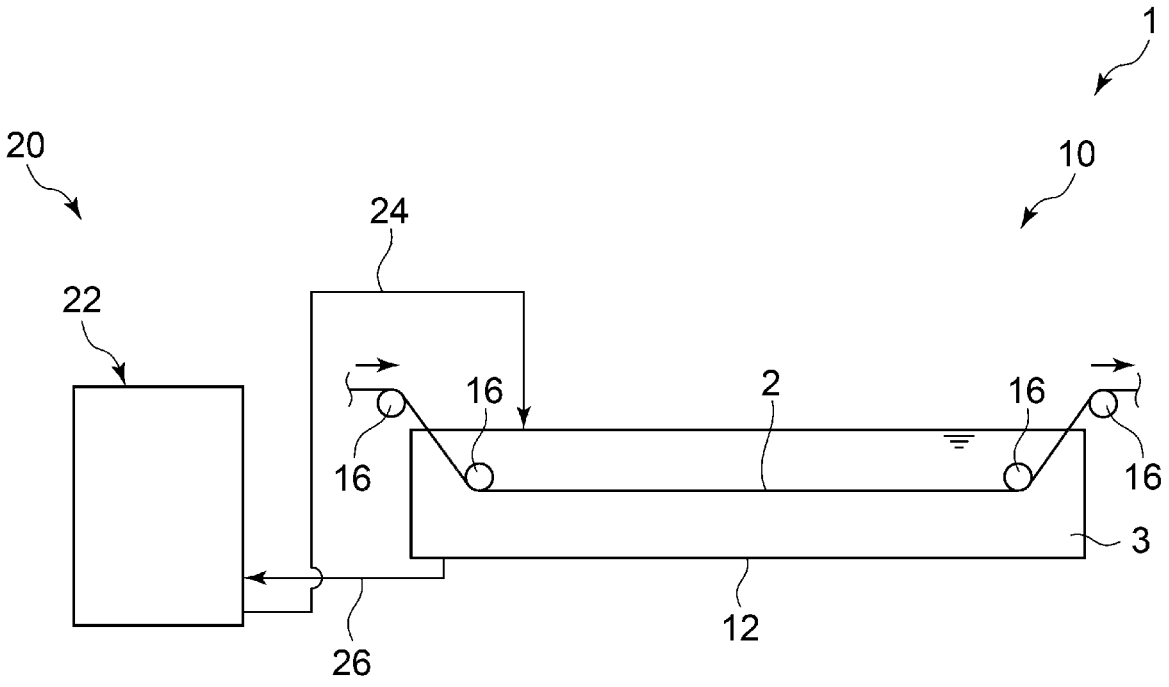
FIG. 1 is a schematic diagram of a pickling facility according to an embodiment.

Some embodiments of the present invention will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

Figure 2:
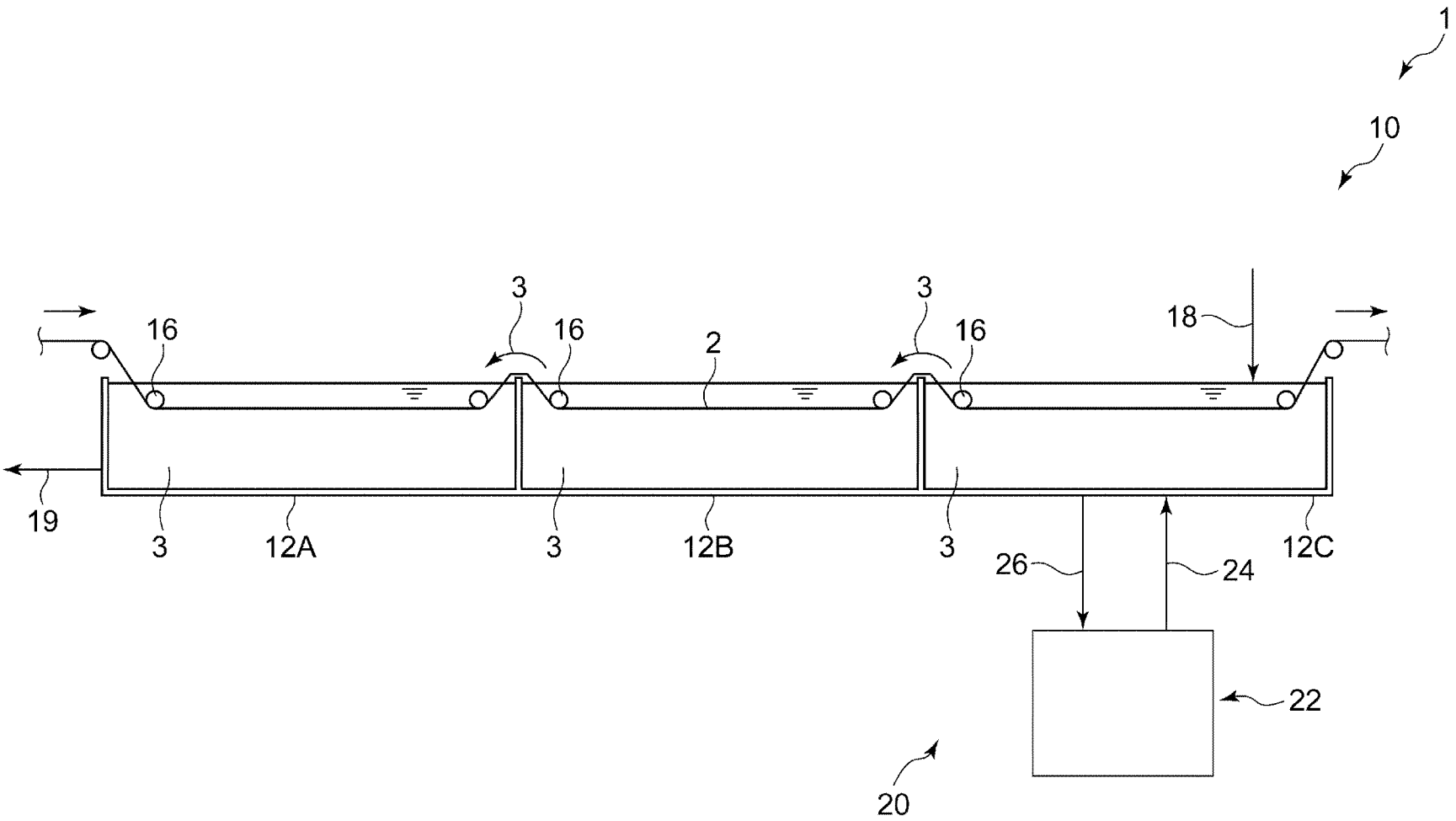
FIG. 2 is a schematic diagram of the pickling facility according to an embodiment.

FIGS. 1 and 2 are each a schematic diagram of a pickling facility according to an embodiment.

First, the overview of the pickling facility according to some embodiments will be described with reference to FIG. 1. As shown in FIG. 1, a pickling facility 1 according to an embodiment includes a pickling device 10 for pickling a steel plate 2 with an acid solution 3, and an acid solution supply apparatus 20 configured to supply the acid solution 3 to the pickling device 10.

The pickling device 10 includes a pickling tank 12 for storing the acid solution 3, and conveyance rolls 16 for continuously conveying the strip-shaped steel plate 2 immersed in the acid solution 3. The acid solution 3 is a pickling solution for dissolving and removing a scale (oxide layer) generated on the surface of the steel plate 2 and is, for example, a solution containing acid such as hydrochloric acid, sulfuric acid, nitric acid or hydrofluoric acid. The conveyance rolls 16 are configured to convey the steel plate 2 applied with a tension, with the steel plate being immersed in the acid solution in the pickling tank.

The acid solution supply apparatus 20 includes an acid solution preparation device 22 for preparing the acid solution to be supplied to the pickling device 10, an acid solution supply line 24 for supplying the acid solution from the acid solution preparation device 22 to the pickling device 10, and an acid solution return line 26 for returning the acid solution from the pickling device 10 to the acid solution preparation device 22.

It is known that, in pickling a steel plate, a pickling speed is increased by regulating a concentration of ferric ions ($Fe^{3+}$) contained in an acid solution.

Figure 12:
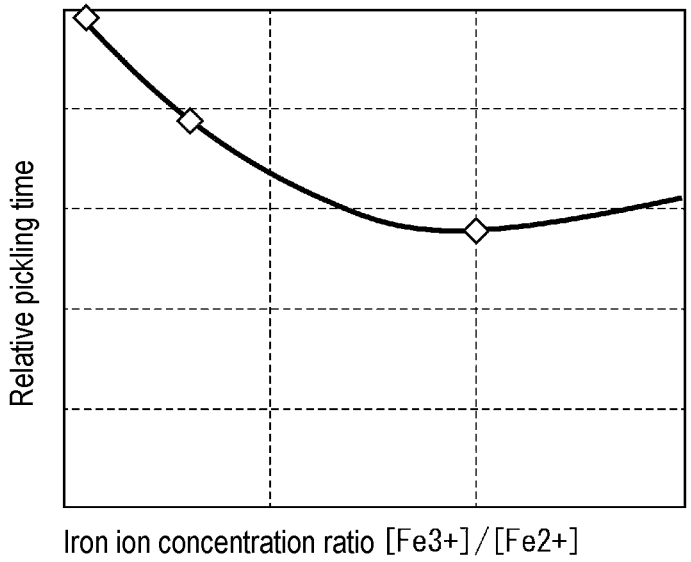
FIG. 12 is a graph showing an example of a relationship between a pickling time and the concentration ratio of iron ions in an acid solution.

FIG. 12 is a graph showing an example of a relationship between a pickling time and the concentration ratio of iron ions ($Fe^{2+}$, $Fe^{3+}$) in an acid solution. As shown in FIG. 12, increasing the $Fe^{3+}$ concentration in the acid solution to some extent, the pickling speed is increased (that is, the pickling time is decreased). Therefore, by appropriately regulating the $Fe^{3+}$ concentration in the acid solution with the acid solution preparation device 22, it is possible to efficiently pickle the steel plate. The configuration of the acid solution preparation device 22 will be described later.

The pickling facility 1 shown in FIG. 2 is a continuous pickling facility that includes the pickling device 10 with a plurality of pickling tanks 12 (12A to 12C) disposed in series in a conveying direction of the steel plate 2. The plurality of pickling tanks 12 (12A to 12C) are partitioned by partition walls, respectively.

Each of the plurality of pickling tanks 12 (12A to 12C) is provided with the conveyance rolls 16, and the conveyance rolls 16 convey the steel plate 2 with the steel plate 2 being immersed in the acid solution 3 in the plurality of pickling tanks 12.

In the pickling facility 1 shown in FIG. 2, the acid solution 3 for pickling the steel plate 2 is supplied to the most-downstream pickling tank 12C via an acid solution supply part 18. Further, the acid solution 3 overflowing from the pickling tanks 12 (12A to 12C) is transferred to the upstream pickling tank over the partition wall between the pickling tanks 12. The most-upstream pickling tank 12A is provided with an acid solution discharge part 19 for discharging the acid solution 3.

Moreover, the pickling facility 1 shown in FIG. 2 includes the acid solution supply line 24 and the acid solution return line 26 between the acid solution preparation device 22 and the most-downstream pickling tank 12C. That is, the acid solution prepared by the acid solution preparation device 22 is supplied to the most-downstream pickling tank 12C.

In the downstream pickling tank 12, a treatment of dissolving the surface of a base material for the steel plate 2 may be performed, in addition to dissolving the scale of the surface of the steel plate 2. When the base material for the steel plate 2 is thus dissolved with the acid solution, $Fe^{3+}$ in the acid solution is consumed. Thus, by supplying the acid solution 3 prepared by the acid solution preparation device 22 to the downstream pickling tank (for example, the most-downstream pickling tank 12C) of the plurality of pickling tanks 12, it is possible to effectively pickle the steel plate.

Hereinafter, the acid solution preparation device 22 according to some embodiments will be described in more detail.

FIGS. 3 to 10 are each a schematic diagram of the acid solution supply apparatus including the acid solution preparation device according to an embodiment. As shown in FIGS. 3 to 10, the acid solution preparation device 22 according to some embodiments includes a sealed tank 30 for storing the acid solution 3, a gas supply part 31, and a purge part 33.

The sealed tank 30 is supplied with an oxygen-containing gas from the outside via a gas supply part 31. Further, the gas in the sealed tank 30 can be discharged from the sealed tank 30 to the outside via the purge part 33.

The sealed tank 30 stores the acid solution 3 for pickling the steel plate. In the sealed tank 30, a liquid phase portion 101 including the stored acid solution 3 and a gas phase portion 102 are formed.

In some embodiments, the acid solution from the pickling tanks 12 of the pickling device 10 (see FIG. 1, 2) may flow in via the acid solution return line 26 to be stored.

The oxygen-containing gas supplied to the sealed tank 30 may be, for example, an oxygen-containing gas having an oxygen partial pressure higher than an oxygen partial pressure (about 0.021 MPa) of 1 atmospheric pressure and may be, for example, an oxygen-containing gas having an oxygen partial pressure higher than 0.022 MPa.

Alternatively, the oxygen-containing gas may have an oxygen concentration higher than an oxygen concentration (about 20.95%) in the atmosphere and may have, for example, an oxygen concentration of at least 20.1%. Alternatively, the oxygen-containing gas may have an oxygen partial pressure increased by pressurizing a gas such as air.

In some embodiments, the acid solution preparation device 22 may have a function of generating the oxygen-containing gas supplied to the sealed tank 30. For example, in the exemplary embodiment shown in FIG. 3, the acid solution preparation device 22 includes an oxygen gas generating device 38 and a pressurizing part 40. Then, the gas generated by the oxygen gas generating device 38 is pressurized by the pressurizing part 40, and then supplied to the sealed tank 30 via the gas supply part 31 including the oxygen gas supply line 36. The pressurizing part 40 may be a compressor.

The oxygen gas generating device 38 is configured to generate, from air, a gas having a higher oxygen concentration than air. The oxygen gas generating device 38 may be configured to generate a gas having an oxygen concentration of at least 90 mass %.

Alternatively, in some embodiments, a gas from an oxygen-containing gas source outside the acid solution preparation device 22 may be supplied to the gas supply part 31. For example, an oxygen gas cylinder where high-pressure oxygen is stored may be used as the above-described oxygen-containing gas source. Alternatively, for example, a component obtained by pressurizing air may be used as the oxygen-containing gas source. In this case, the acid solution preparation device 22 may include a compressor (pressurizing part) for pressurizing air.

In the embodiments shown in FIGS. 3 to 10, the gas supply part 31 may include a gas supply pipe 32.

In the exemplary embodiments shown in FIGS. 3 to 6, the gas supply pipe 32 is connected to the sealed tank 30, and the oxygen-containing gas flows into the sealed tank 30 from a supply port formed by one end of the gas supply pipe 32.

Figure 3:
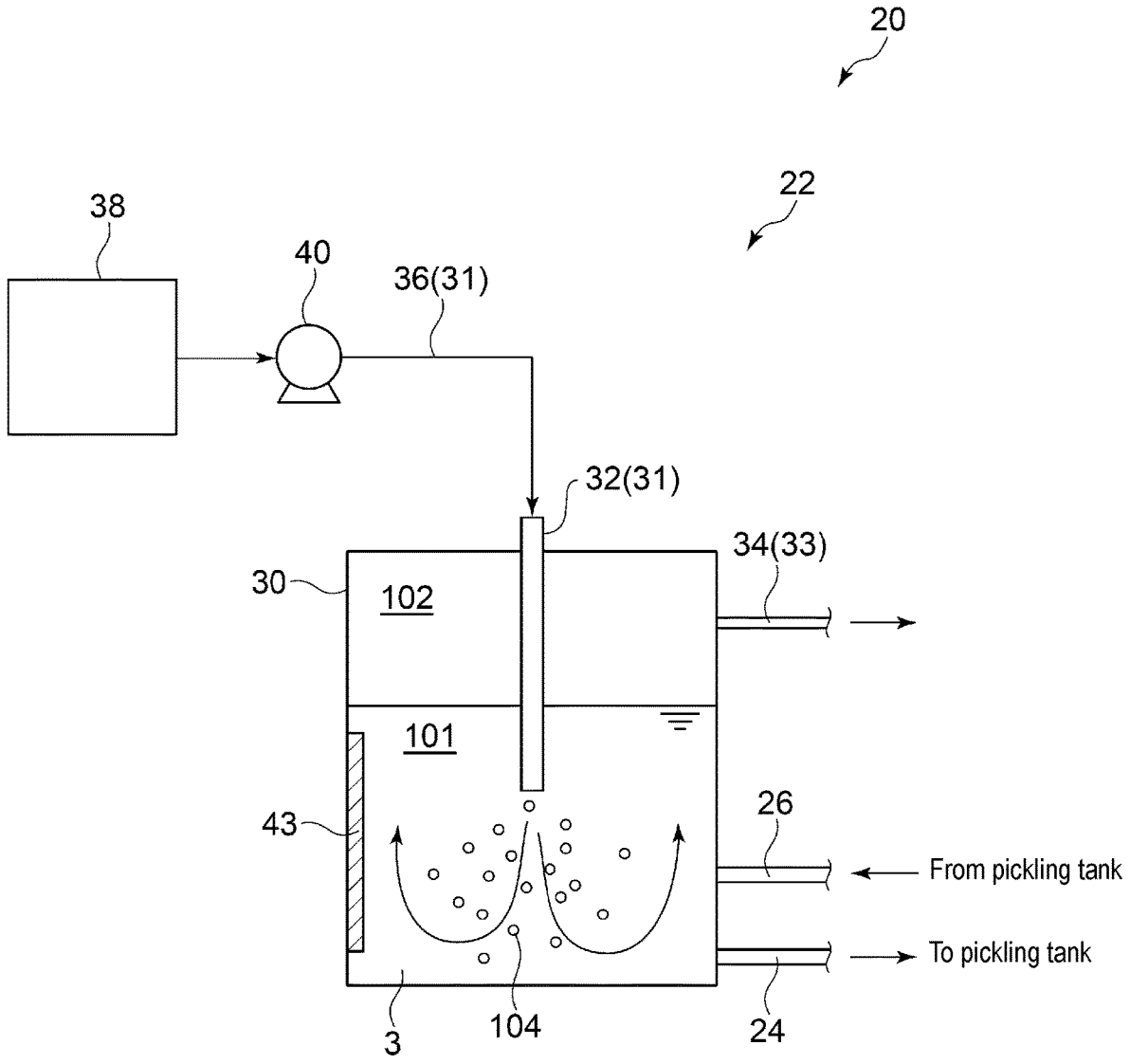
FIG. 3 is a schematic diagram of an acid solution supply apparatus including an acid solution preparation device according to an embodiment.

In the exemplary embodiment shown in FIG. 3, the supply port of the gas supply pipe 32 is disposed in the acid solution 3 stored in the sealed tank 30 (that is, the liquid phase portion 101), and the oxygen-containing gas is blown into the acid solution 3. In the exemplary embodiments shown in FIGS. 4 to 6, the one end of the gas supply pipe 32 is connected to the sealed tank 30, and the oxygen-containing gas from the gas supply pipe 32 is supplied to the gas phase portion 102 in the sealed tank 30.

In the exemplary embodiments shown in FIGS. 7 to 10, the gas supply pipe 32 is connected to a gas circulation passage 50 to be described later, and the oxygen-containing gas from the gas supply pipe 32 is supplied into the sealed tank 30 via, for example, a part of the gas circulation passage 50.

Further, in the embodiments shown in FIGS. 3 to 10, the purge part 33 may include a purge pipe 34.

In the exemplary embodiments shown in FIGS. 3 to 6, the purge pipe 34 is connected to the gas phase portion 102 in the sealed tank 30, and a gas from the gas phase portion 102 is discharged to the outside via the purge pipe 34.

In the exemplary embodiments shown in FIGS. 7 to 10, the purge pipe 34 is connected to the gas circulation passage 50 to be described later, and the gas of the gas phase portion 102 in the sealed tank 30 is discharged to the outside via the part of the gas circulation passage 50 and the purge pipe 34.

In the above-described embodiments, since it is possible to supply the oxygen-containing gas to the sealed tank 30 via the gas supply part 31, as well as it is possible to discharge the gas in the sealed tank 30 to the outside via the purge part 33 if the oxygen concentration is decreased by consuming the oxygen-containing gas in the sealed tank 30, an oxygen gas partial pressure in the sealed tank 30 is regulated easily. That is, since it is possible to regulate a dissolved oxygen concentration in the acid solution 3 in the sealed tank 30, it is possible to regulate an oxidation reaction rate from ferrous ions ($Fe^{2+}$) to ferric ions ($Fe^{3+}$) in the acid solution 3 in the sealed tank 30. Thus, it is possible to appropriately regulate the $Fe^{3+}$ concentration in the acid solution 3 in the sealed tank 30, making it is possible to efficiently pickle the steel plate 2 (see FIG. 1).

In some embodiments, the gas supply pipe 32 is provided with a first valve 35 (for example, see FIGS. 5 and 7 to 10) for regulating a pressure of the gas supply pipe 32. In this case, by appropriately operating the first valve 35, it is possible to supply the oxygen-containing gas to the sealed tank 30 while appropriately regulating a pressure in the sealed tank 30.

In some embodiments, the purge pipe 34 is provided with a second valve 37 (for example, see FIGS. 5 and 7 to 10) for regulating a flow rate of the gas discharged from the sealed tank 30 via the purge pipe 34. In this case, by appropriately operating the second valve 37, it is possible to discharge the gas from the sealed tank while appropriately regulating the pressure in the sealed tank 30 and the oxygen concentration in gas phase.

In some embodiments, the purge pipe 34 may be configured to continuously discharge a gas at a constant flow rate. For example, in the purge pipe 34, an orifice for discharging the gas at a predetermined flow rate may be disposed.

In some embodiments, the acid solution preparation device 22 is provided with a pressure sensor 92 for measuring the pressure in the sealed tank 30. For example, in the exemplary embodiments shown in FIGS. 4 to 6, the pressure sensor 92 is configured to measure the pressure of the gas phase portion in the sealed tank 30.

Further, in some embodiments, the acid solution preparation device 22 is provided with a concentration sensor 94 for measuring the oxygen concentration in the gas phase portion 102 in the sealed tank 30. For example, in the exemplary embodiments shown in FIGS. 4 to 6, the concentration sensor 94 is configured to measure the concentration of the gas phase portion 102 in the sealed tank 30.

The oxygen concentration in the gas in the purge pipe 34 (purge part 33) through which the gas discharged from the sealed tank 30 passes is substantially the same as the oxygen concentration in the gas in the sealed tank 30. Thus, in some embodiments, the concentration sensor 94 may be configured to measure the oxygen concentration in the gas in the purge part 33.

The first valve 35 disposed on the gas supply pipe 32 may be configured such that an opening degree thereof is adjusted based on a measurement result by the pressure sensor 92. Thus adjusting the opening degree of the first valve 35 based on the measurement result of the pressure in the sealed tank 30, it is possible to regulate the pressure in the sealed tank 30 more appropriately.

The first valve 35 may be configured such that the opening degree thereof is adjusted based on the measurement results by the pressure sensor 92 and the concentration sensor 94. In this case, since it is possible to calculate the oxygen partial pressure in the sealed tank 30 from the measurement results by the pressure sensor 92 and the concentration sensor 94, it is possible to appropriately regulate the pressure (total pressure) and the oxygen partial pressure in the sealed tank 30.

The second valve 37 disposed on the purge pipe 34 may be configured such that an opening degree thereof is adjusted based on a measurement result by the concentration sensor 94. Thus adjusting the opening degree of the second valve 37 based on the measurement result of the oxygen concentration in the sealed tank 30, it is possible to discharge the gas from the sealed tank 30 while regulating the oxygen gas concentration in the sealed tank 30 more appropriately.

The second valve 37 may be configured such that the opening degree thereof is adjusted based on the measurement results by the pressure sensor 92 and the concentration sensor 94. In this case, since it is possible to calculate the oxygen partial pressure in the sealed tank 30 from the measurement results by the pressure sensor 92 and the concentration sensor 94, it is possible to discharge the gas from the sealed tank 30 while appropriately regulating the pressure (total pressure) and the oxygen partial pressure in the sealed tank 30.

Figure 5:
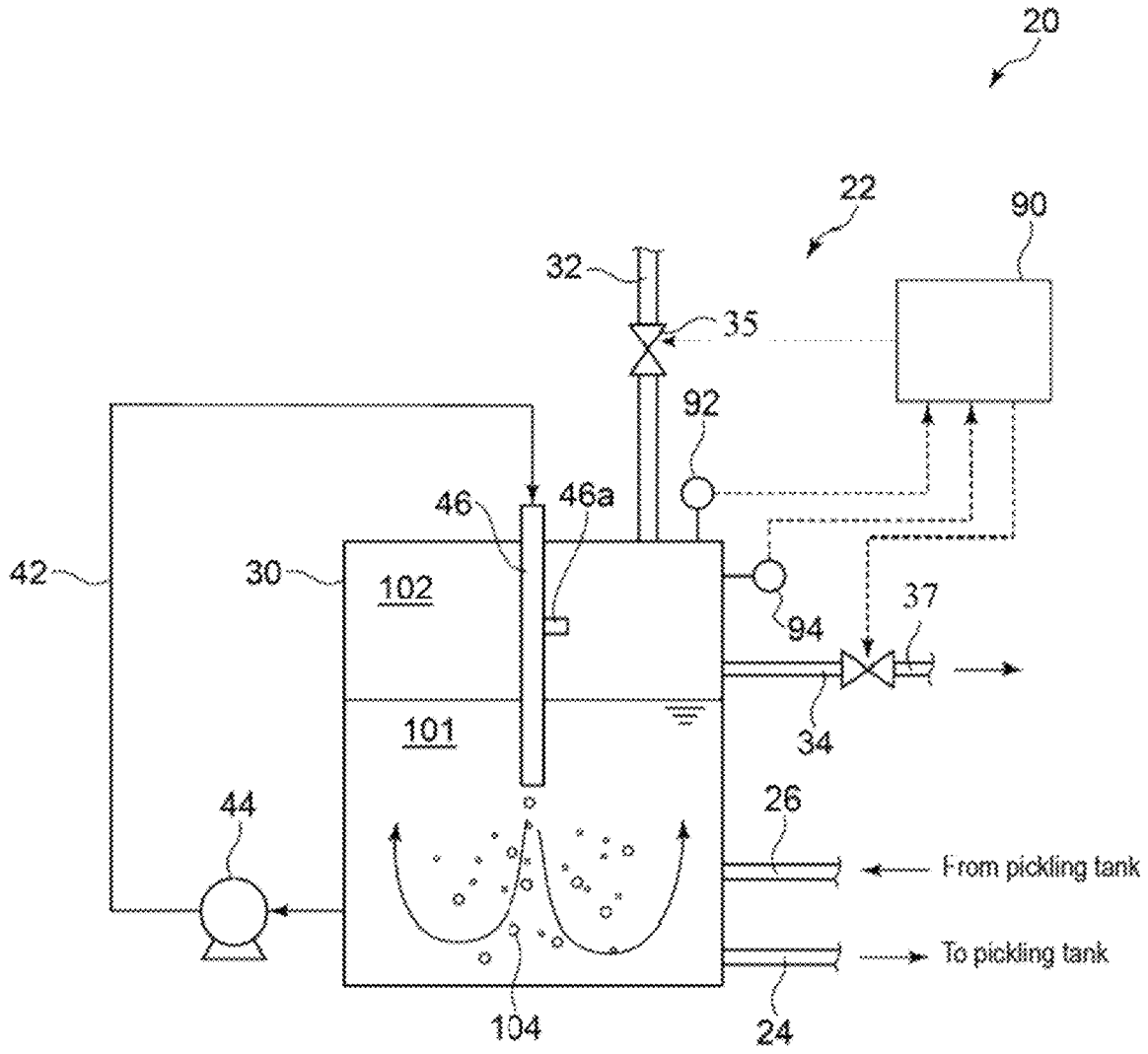
FIG. 5 is a schematic diagram of the acid solution supply apparatus including the acid solution preparation device according to an embodiment.

In some embodiments, for example, as shown in FIG. 5, the acid solution preparation device 22 may include a controller 90 for adjusting the opening degree of the first valve 35 and/or the second valve 37. The controller 90 may be configured to adjust the opening degree of the first valve 35 and/or the second valve 37 based on the measurement results by the pressure sensor 92 and the concentration sensor 94. Further, the controller 90 may be configured to adjust the opening degree of the first valve 35 and/or the second valve 37 based on the measurement results by the pressure sensor 92 and the concentration sensor 94.

In some embodiments, for example, as shown in FIG. 3, the acid solution preparation device 22 further includes a temperature regulating part 43 for regulating a temperature of the acid solution 3 stored in the sealed tank 30. In this case, since it is possible to regulate the temperature of the acid solution 3 in the sealed tank 30 by the temperature regulating part 43, it is possible to accelerate an oxidation-reduction reaction of iron ions in the sealed tank 30. Thus, it is possible to regulate the $Fe^{3+}$ concentration in the acid solution 3 in the sealed tank 30 more efficiently.

The temperature regulating part 43 may be a heater disposed in the sealed tank 30 or an acid solution circulation passage 42 (to be described later).

In some embodiments, for example, as shown in FIGS. 4 to 6, 9, and 10, the acid solution preparation device 22 includes the acid solution circulation passage 42 and a circulation pump 44 disposed on the acid solution circulation passage 42. The acid solution circulation passage 42 is configured to extract the acid solution 3 stored in the sealed tank 30 out of the sealed tank 30 and to circulate the acid solution 3 to be returned to the sealed tank 30.

In this case, since the acid solution 3 in the sealed tank 30 is circulated via the acid solution circulation passage 42 and the circulation pump 44, it is possible to stir the solution in the sealed tank 30. Thus, it is possible to accelerate dissolution of the oxygen gas into the acid solution 3 in the sealed tank 30, and to increase the dissolved oxygen concentration in the acid solution 3. Thus, the oxidation reaction rate of iron ions and the $Fe^{3+}$ concentration in the acid solution 3 in the sealed tank 30 are regulated easily.

Moreover, in some embodiments, for example, as shown in FIGS. 7 to 10, the acid solution preparation device 22 includes the gas circulation passage 50 for extracting the gas of the gas phase portion 102 in the sealed tank 30 out of the sealed tank 30 and circulating the gas to be returned to the sealed tank 30.

In this case, the gas of the gas phase portion 102 in the sealed tank 30 is supplied to a gas mixing part 46 (to be described later) or a gas blowing part 52 (to be described later) while being circulated via the gas circulation passage 50, making it possible to continuously mix or blow the gas into the acid solution 3 by using the oxygen gas existing in the gas phase portion 102 of the sealed tank 30. Thus, it is possible to efficiently increase the dissolved oxygen concentration in the acid solution 3.

In the exemplary embodiments shown in FIGS. 4, 5, 9, and 10, the acid solution preparation device 22 includes the gas mixing part 46 for mixing the gas in the acid solution 3. The gas mixing part 46 is supplied with the acid solution 3 extracted from the sealed tank 30 via the acid solution circulation passage 42, and is configured to mix the oxygen-containing gas in the thus supplied acid solution 3. Then, the acid solution 3 mixed in the oxygen-containing gas by the gas mixing part 46 is released from the gas mixing part 46 into the sealed tank 30 to be stored therein.

Figure 4:
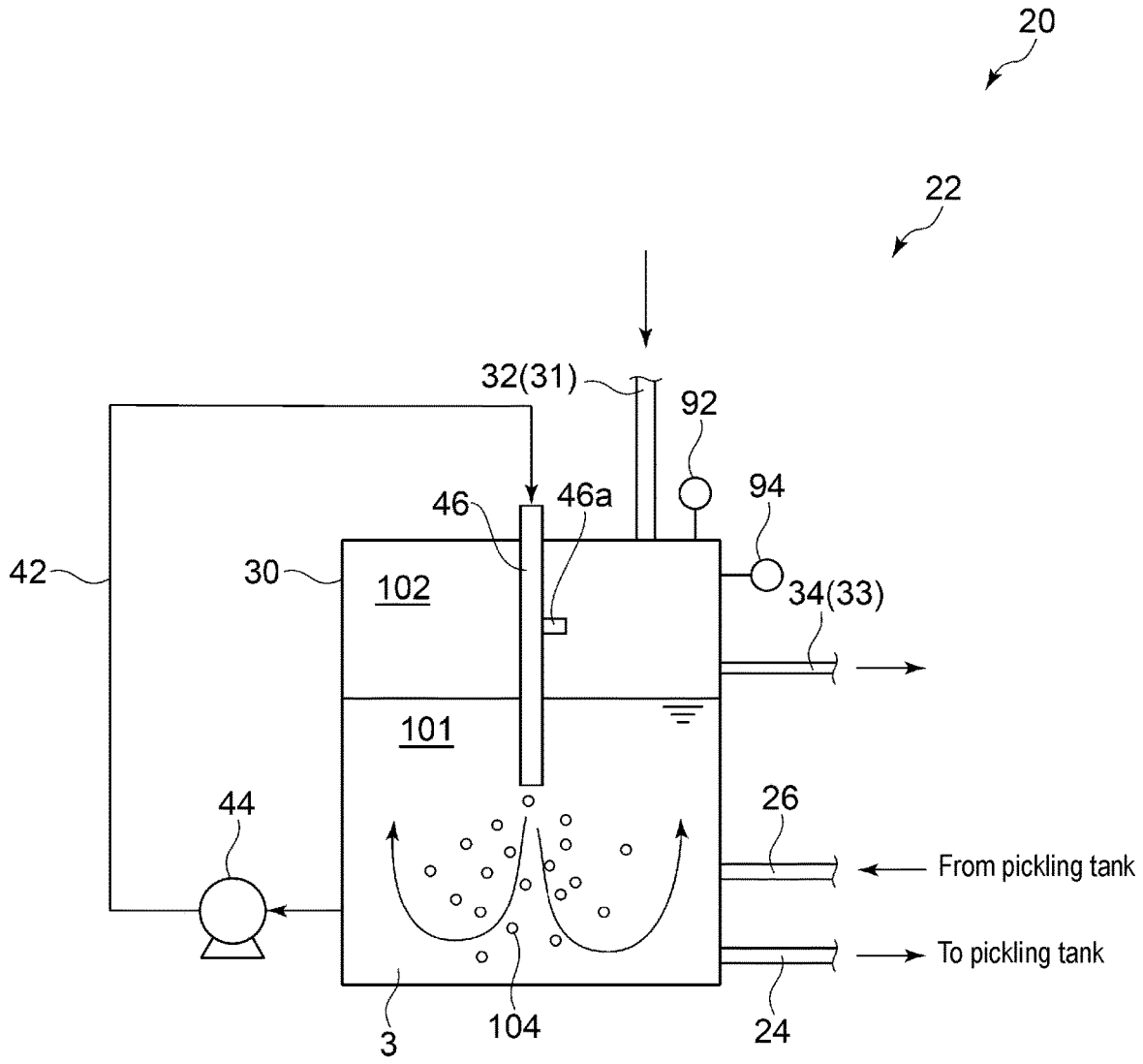
FIG. 4 is a schematic diagram of the acid solution supply apparatus including the acid solution preparation device according to an embodiment.

In the exemplary embodiments shown in FIGS. 4 and 5, the gas mixing part 46 is an ejector nozzle including a gas intake portion 46*a* for taking in the gas (oxygen-containing gas) of the gas phase portion 102 in the sealed tank 30. In this case, in the gas mixing part 46 (ejector nozzle), the gas of the gas phase portion 102 is withdrawn into a flow of the acid solution 3 formed inside the ejector nozzle via the gas intake portion 46*a*, forming a mixed flow including the acid solution 3 and bubbles of the gas. Then, the acid solution 3 including the bubbles of the oxygen-containing gas is released from the gas mixing part 46 into the sealed tank 30.

Figure 9:
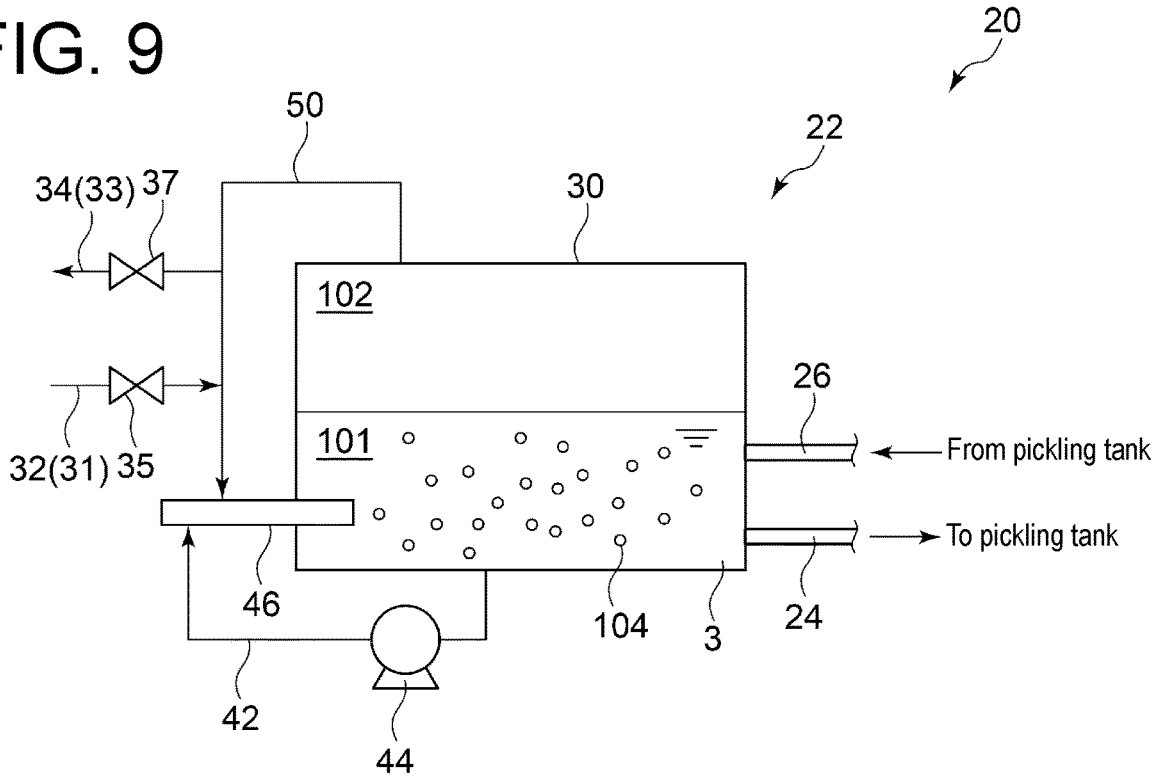
FIG. 9 is a schematic diagram of the acid solution supply apparatus including the acid solution preparation device according to an embodiment.
Figure 10:
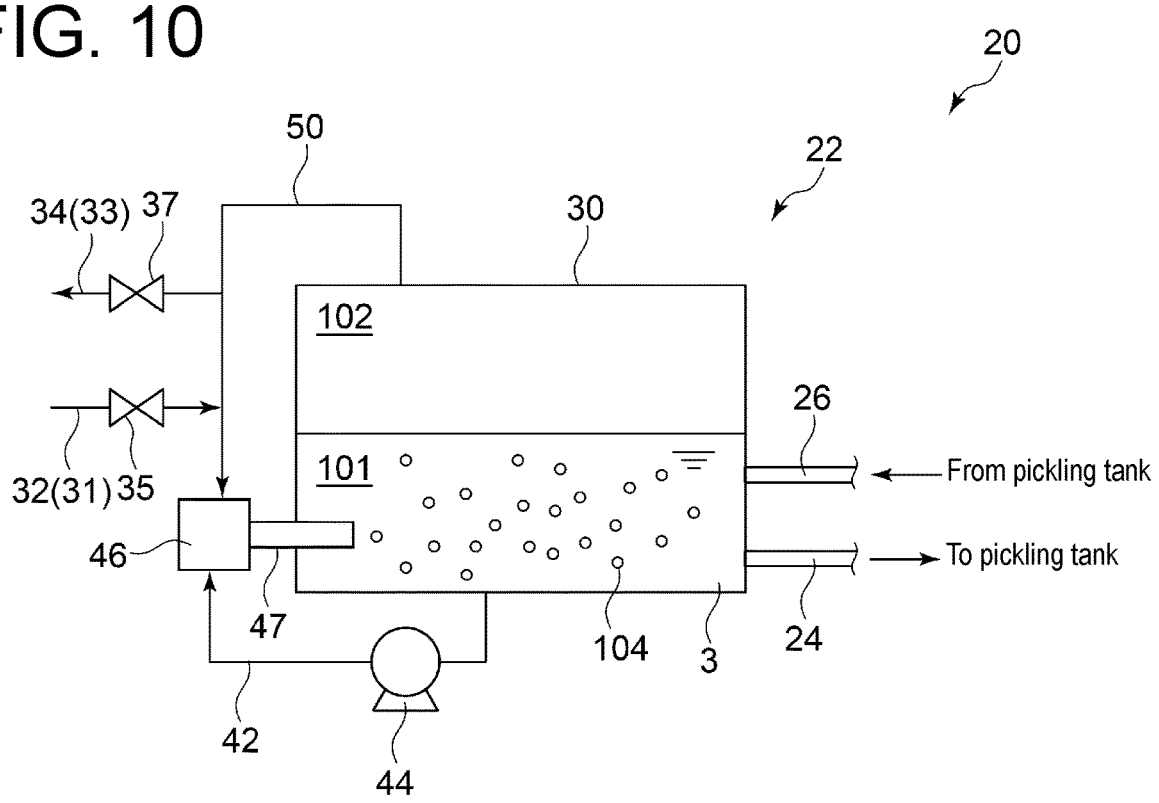
FIG. 10 is a schematic diagram of the acid solution supply apparatus including the acid solution preparation device according to an embodiment.

In the exemplary embodiments shown in FIGS. 9 and 10, the acid solution 3 from the acid solution circulation passage 42 and the oxygen-containing gas from the gas circulation passage 50 are introduced to the gas mixing part 46. Then, mixing the acid solution 3 and the oxygen-containing gas by the gas mixing part 46, the mixed flow including the acid solution 3 and the bubbles of the gas is formed. Then, the acid solution 3 including the bubbles of the oxygen-containing gas is released from the gas mixing part 46 into the sealed tank 30.

In the exemplary embodiment shown in FIG. 10, the gas mixing part 46 is disposed outside the sealed tank 30, and a connecting part 47 for connecting the gas mixing part 46 and the sealed tank 30 is disposed. Then, the acid solution 3 including the bubbles of the oxygen-containing gas from the gas mixing part 46 is released into the sealed tank 30 via the connecting part 47.

As the gas mixing part 46, for example, the above-described ejector nozzle, or a fine bubble generating nozzle configured to generate fine bubbles of the oxygen-containing gas in the acid solution 3 in the sealed tank 30 may be used.

In the embodiment shown in FIG. 9 or 10, if the fine bubble generating nozzle is adopted, a place where the fine bubbles are generated in the nozzle is located downstream of inflow portions of both the gas circulation passage 50 and the acid solution circulation passage 42 in the fine bubble generating nozzle (gas mixing part 46).

Since the oxygen-containing gas is thus mixed in the acid solution 3 from the acid solution circulation passage 42 by the gas mixing part 46, contact between the acid solution 3 and the oxygen-containing gas is enhanced, accelerating dissolution of the oxygen gas into the acid solution 3. Then, since the acid solution 3 of the gas mixing part 46 is returned to the sealed tank 30, it is possible to increase the dissolved oxygen concentration in the acid solution 3 in the sealed tank 30 more effectively. Thus, the oxidation reaction rate of iron ions and the $Fe^{3+}$ concentration in the acid solution 3 in the sealed tank 30 are regulated easily.

Figure 6:
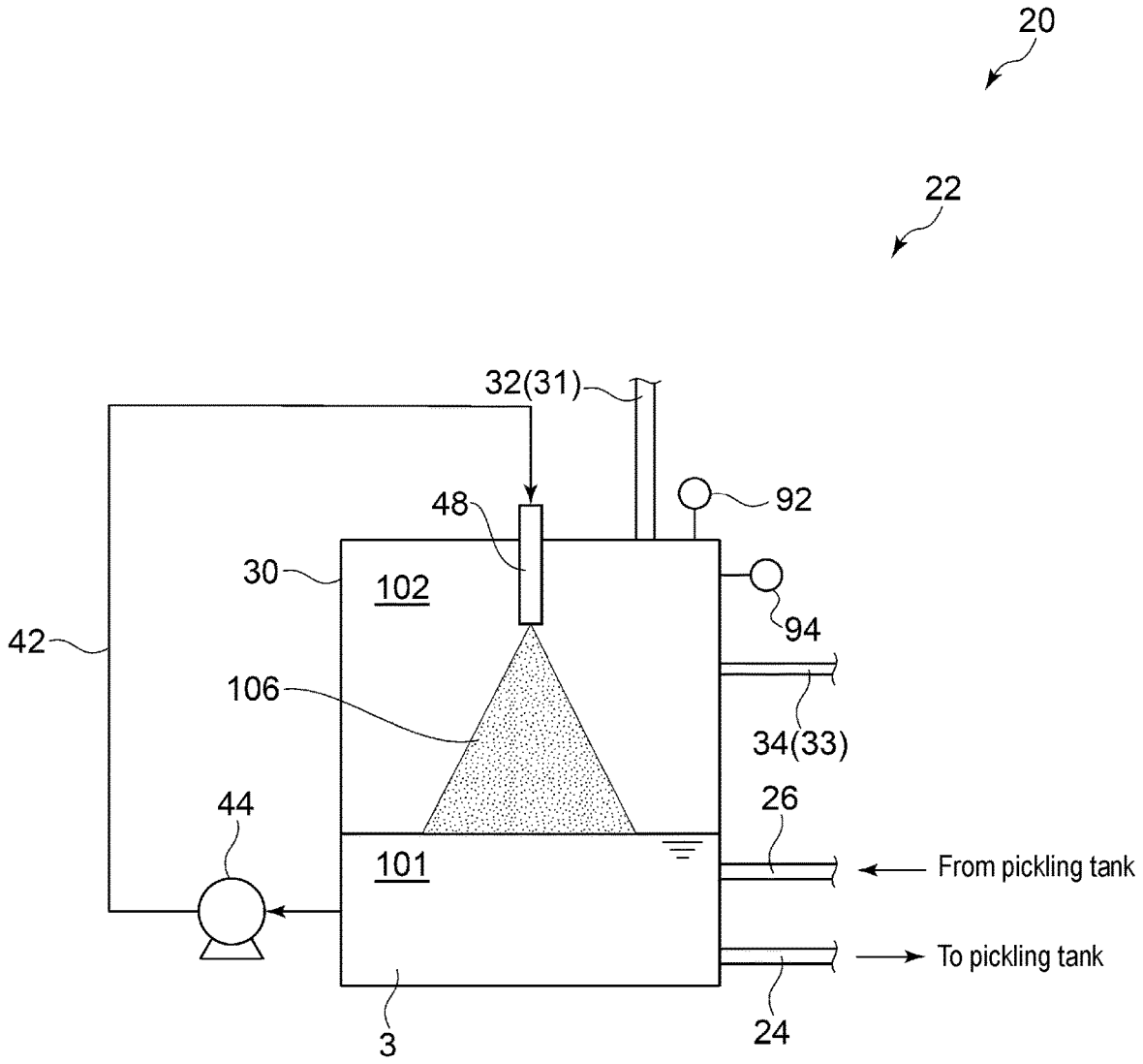
FIG. 6 is a schematic diagram of the acid solution supply apparatus including the acid solution preparation device according to an embodiment.

In the exemplary embodiment shown in FIG. 6, the acid solution preparation device 22 includes an injection part 48 for forming droplets 106 by injecting the acid solution 3 from the acid solution circulation passage 42 to the gas phase portion 102 in the sealed tank 30. In the present embodiment, the acid solution circulation passage 42 is configured to circulate the acid solution 3 to be returned to the gas phase portion 102 of the sealed tank 30.

The injection part 48 may be configured to inject the acid solution 3 in a droplet state. Alternatively, the injection part 48 may be configured to inject the acid solution 3 such that the injected acid solution 3 is divided into the droplets. A spray may be used as the injection part 48.

Thus injecting the acid solution 3 returned from the acid solution circulation passage 42 to the sealed tank 30 in the gas phase portion 102 of the sealed tank 30, it is possible to form the droplets 106 of the acid solution 3 in the gas phase portion 102. Thus, a contact area between the oxygen-containing gas and the acid solution 3 in the gas phase portion 102 is increased, accelerating dissolution of the oxygen gas into the acid solution 3. Thus, it is possible to increase the dissolved oxygen concentration in the acid solution 3, easily regulating the oxidation reaction rate of iron ions and the $Fe^{3+}$ concentration in the acid solution 3 in the sealed tank 30.

Although not illustrated in particular, in some embodiments, the acid solution preparation device 22 includes the above-described gas mixing part 46 and injection part 48, and may use them in combination. In this case, it may be configured such that the acid solution circulation passage 42 branches midway, supplies the acid solution 3 to the gas mixing part 46 via one of branch passages, and supplies the acid solution 3 to the injection part 48 via another branch passage.

Figure 7:
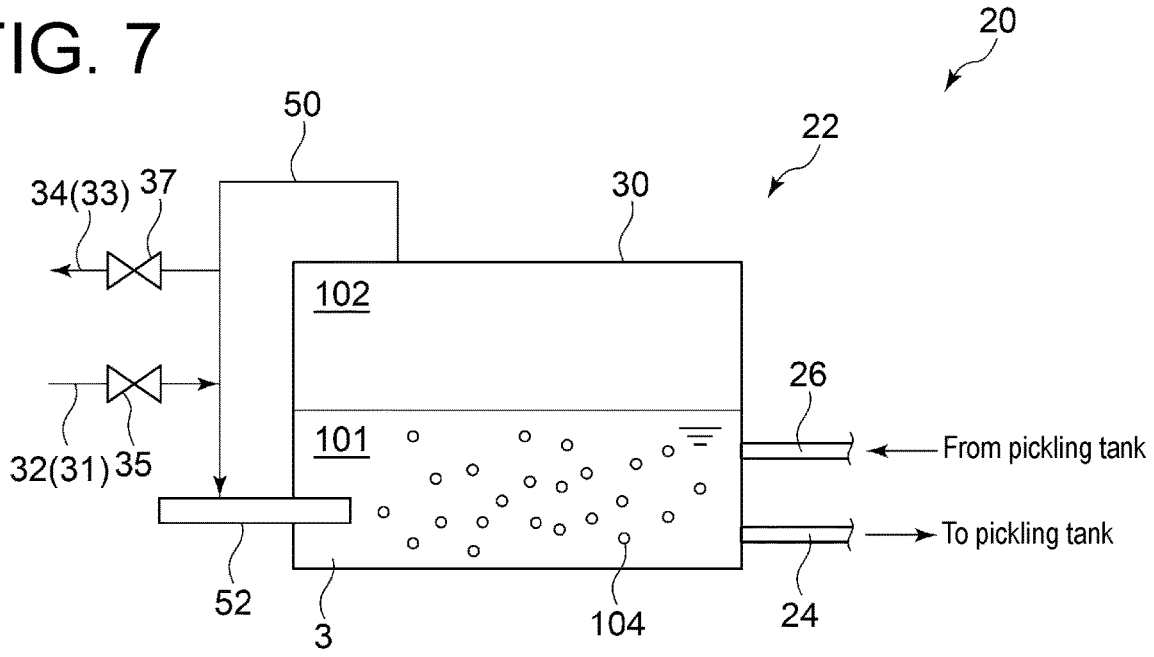
FIG. 7 is a schematic diagram of the acid solution supply apparatus including the acid solution preparation device according to an embodiment.
Figure 8:
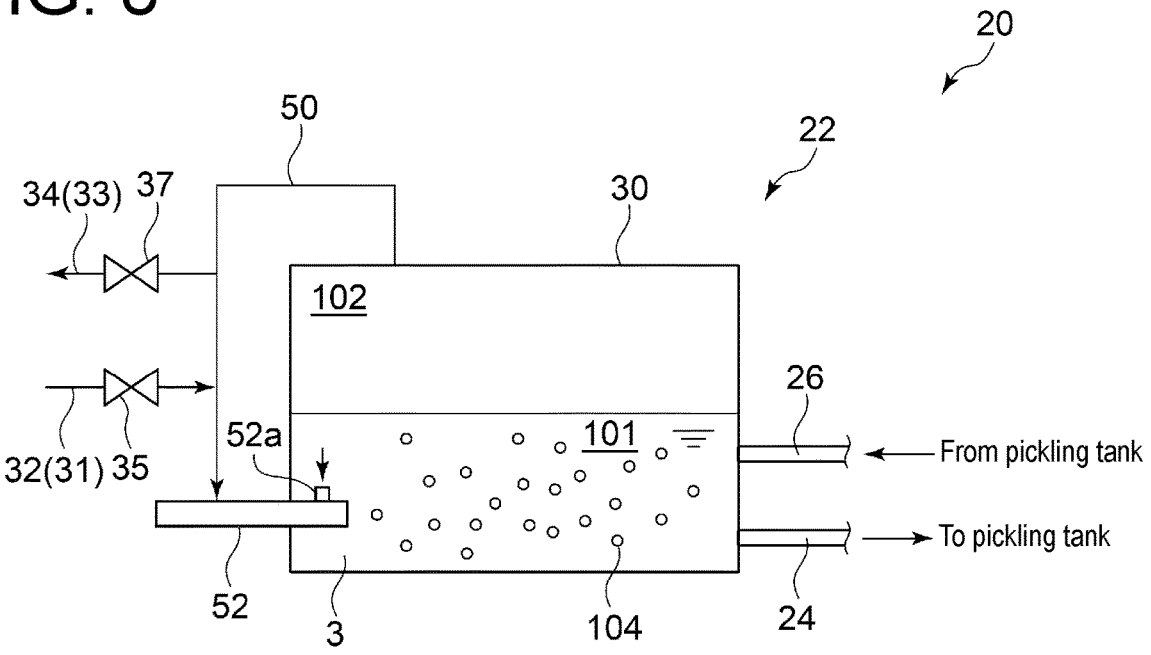
FIG. 8 is a schematic diagram of the acid solution supply apparatus including the acid solution preparation device according to an embodiment.

In the exemplary embodiments shown in FIGS. 3, 7, and 8, the acid solution preparation device 22 further includes the gas blowing part 52 for blowing the oxygen-containing gas into the acid solution 3 stored in the sealed tank 30.

In this case, since the oxygen-containing gas is blown into the acid solution 3 in the sealed tank 30 by the gas blowing part 52, it is possible to form bubbles 104 of the oxygen-containing gas in the acid solution 3. Thus, the contact area between the acid solution 3 and the oxygen-containing gas is increased, making it possible to accelerate dissolution of the oxygen gas into the acid solution 3. Thus, it is possible to increase the dissolved oxygen concentration in the acid solution 3, easily regulating the oxidation reaction rate of iron ions and the $Fe^{3+}$ concentration in the acid solution 3 in the sealed tank 30.

The gas blowing part 52 may be the fine bubble generating nozzle configured to generate fine bubbles of the oxygen-containing gas in the acid solution 3 in the sealed tank 30.

In the embodiment shown in FIG. 7 or 8, if the fine bubble generating nozzle is adopted, a place where the fine bubble are generated in the nozzle may be inside or outside the sealed tank 30, and the acid solution 3 in the sealed tank 30 enters into the place.

In the exemplary embodiment shown in FIG. 8, the gas blowing part 52 includes an acid solution intake portion 52*a* for taking in the acid solution 3 from the liquid phase portion 101 in the sealed tank 30. Then, the surrounding acid solution 3 is taken in via the acid solution intake portion 52*a* by using gas jet generated when the gas is blown into the acid solution 3 in the sealed tank 30, and is caught into the nozzle, thereby generating fine bubbles.

In some embodiments, it is configured such that the oxygen-containing gas from the gas supply part 31 is supplied to one of the gas mixing part 46 or the gas blowing part 52 without via the gas phase portion 102 in the sealed tank 30.

For example, in the exemplary embodiments shown in FIGS. 7 to 10, the gas supply pipe 32 (gas supply part 31) is connected to the gas circulation passage 50, and the oxygen-containing gas from the gas supply pipe 32 is supplied to the gas mixing part 46 (in the case of FIG. 9, 10) or the gas blowing part 52 (in the case of FIG. 7, 8) via a part of the gas circulation passage 50.

In the sealed tank 30, oxygen is consumed by the oxidation-reduction reaction of iron ions in the acid solution 3, and thus the oxygen concentration in the gas of the gas phase portion 102 in the sealed tank 30 is decreased unless the oxygen-containing gas is replenished via the gas supply part 31.

In this regard, in the above-described embodiment, it is possible to supply the oxygen-containing gas of relatively high concentration from the gas supply part 31 to the gas mixing part 46 or the gas blowing part 52 without via the gas phase portion 102 in the sealed tank 30 of relatively low concentration. Thus, it is possible to further accelerate dissolution of the oxygen gas into the acid solution 3 in the gas mixing part 46 or the gas blowing part 52. Thus, it is possible to increase the dissolved oxygen concentration in the acid solution 3, easily regulating the oxidation reaction rate of iron ions and the $Fe^{3+}$ concentration in the acid solution 3 in the sealed tank 30.

In some embodiments, for example, as shown in FIGS. 7 to 10, the gas supply part 31 includes the gas supply pipe 32 connected to the gas circulation passage 50. Then, the oxygen-containing gas is supplied to the sealed tank 30 via the gas circulation passage 50 and the gas mixing part 46 (in the case of FIG. 9, 10) or the gas blowing part 52 (in the case of FIG. 7, 8).

In this case, since the oxygen-containing gas from the gas supply pipe 32 is supplied to the gas mixing part 46 or the gas blowing part 52 via the gas circulation passage 50, it is possible to simplify the device structure as compared with the case where the oxygen-containing gas from the gas supply pipe 32 is supplied to the gas mixing part 46 or the gas blowing part 52 through a passage different from the gas circulation passage 50.

In some embodiments, for example, as shown in FIGS. 7 to 10, the purge part 33 includes the purge pipe 34 connected to the gas circulation passage 50, and is configured to discharge the gas in the sealed tank 30 to the outside of the sealed tank 30 via the gas circulation passage 50.

In this case, since the purge pipe 34 is connected to the gas circulation passage 50, it is possible to reduce a connection section between the sealed tank 30 and an external pipe as compared with the case where the purge pipe 34 is connected to the sealed tank 30. Thus, seal performance of the sealed tank 30 is further improved, making it possible to regulate the oxygen partial pressure in the sealed tank 30 more reliably.

Figure 11:
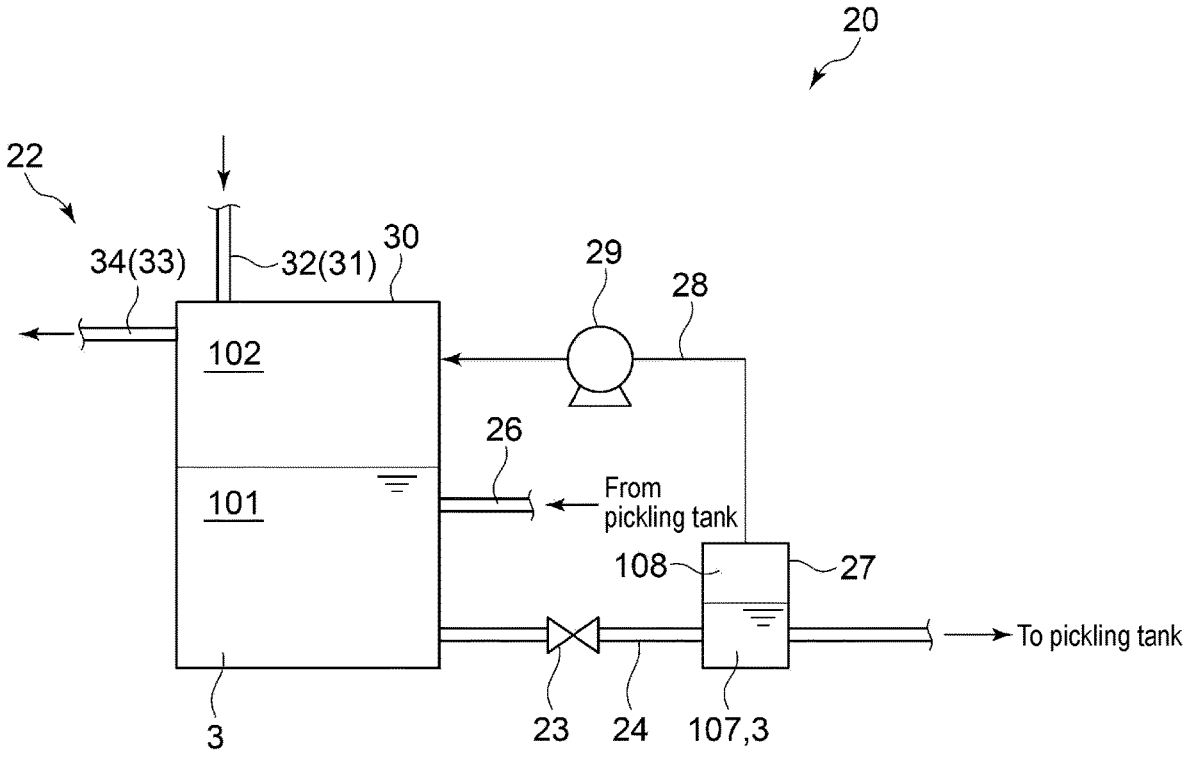
FIG. 11 is a schematic diagram of the acid solution supply apparatus according to an embodiment.

FIG. 11 is a schematic diagram of the acid solution supply apparatus according to an embodiment.

The configuration of the acid solution supply apparatus 20 shown in FIG. 11 is basically the same as the acid solution supply apparatus 20 included in the pickling facility 1 shown in FIG. 1, but further includes the features to be described below.

The acid solution supply apparatus 20 shown in FIG. 11 includes the above-described acid solution preparation device 22, the acid solution supply line 24 for supplying the acid solution 3 stored in the sealed tank 30 of the acid solution preparation device 22 to the pickling device (see FIG. 1), and a gas recovery container 27 and a pressure reducing valve 23 disposed on the acid solution supply line 24. The pressure reducing valve 23 is disposed upstream of the gas recovery container 27 on the acid solution supply line 24.

According to the above-described embodiment, since the gas recovery container 27 and the pressure reducing valve 23 are disposed on the acid solution supply line 24 for supplying the acid solution 3 from the sealed tank 30 to the pickling device 10, by reducing a pressure of the acid solution supply line 24 with the pressure reducing valve 23 to expand the bubbles in the acid solution 3, it is possible to recover the oxygen gas, which was separated from the acid solution 3 of the gas recovery container 27 and could not be dissolved into the acid solution 3, in the gas recovery container 27, for example, as shown in FIG. 11. As shown in FIG. 11, in the gas recovery container 27, an oxygen gas 108 that cannot be dissolved into the acid solution 3 due to pressure reduction is stored separately from the acid solution 3 (liquid phase portion 107). Thus, it is possible to recover residual oxygen contained in the acid solution 3 of the acid solution supply line 24 to effectively be utilized.

As shown in FIG. 11, the acid solution supply apparatus 20 may be provided with a return line 28 and a return pump 29 for sending the oxygen gas 108 in the gas recovery container 27 to the sealed tank 30. Thus, the oxygen gas 108 stored in the gas recovery container 27 may be returned to the sealed tank 30 to be used as an oxidant for the oxidation-reduction reaction of iron ions in the acid solution 3 in the sealed tank 30.

The overview of the acid solution preparation device, the acid solution supply apparatus, and the pickling facility according to some embodiments will be described below.

(1) An acid solution preparation device according to at least one embodiment of the present invention is an acid solution preparation device for preparing an acid solution used for pickling of a steel plate, the device including a sealed tank for storing the acid solution, a gas supply part for supplying an oxygen-containing gas from outside of the sealed tank to the sealed tank, and a purge part for discharging a gas in the sealed tank to the outside.

With the above configuration (1), since it is possible to supply the oxygen-containing gas to the sealed tank, as well as it is possible to discharge the gas in the sealed tank to the outside if the oxygen concentration is decreased by consuming the oxygen-containing gas in the sealed tank, the oxygen gas partial pressure in the sealed tank is regulated easily. That is, since it is possible to regulate a dissolved oxygen concentration in the acid solution in the sealed tank, it is possible to regulate an oxidation reaction rate from ferrous ions ($Fe^{2+}$) to ferric ions ($Fe^{3+}$) in the acid solution in the sealed tank. Thus, it is possible to appropriately regulate the $Fe^{3+}$ concentration in the acid solution in the sealed tank, making it is possible to efficiently pickle the steel plate.

(2) In some embodiments, in the above configuration (1), the gas supply part is configured to supply the oxygen-containing gas having an oxygen partial pressure higher than 0.022 MPa to the sealed tank.

With the above configuration (2), since it is possible to increase the oxygen partial pressure in the sealed tank to be higher than an oxygen partial pressure of the atmosphere (1 atmospheric pressure), it is possible to increase the dissolved oxygen concentration in the acid solution as compared with a case where the acid solution is treated under the atmospheric pressure. Thus, it is possible to increase the oxidation reaction rate of iron ions in the acid solution in the sealed tank, making it possible to efficiently regulate the $Fe^{3+}$ concentration in the acid solution.

(3) In some embodiments, in the above configuration (1) or (2), the gas supply part includes a gas supply pipe through which the oxygen-containing gas supplied to the sealed tank flows, and a first valve disposed on the gas supply pipe, for regulating a pressure of the gas supply pipe.

With the above configuration (3), since the first valve is disposed on the gas supply pipe for supplying the oxygen-containing gas to the sealed tank, by appropriately operating the first valve, it is possible to supply the oxygen-containing gas to the sealed tank while appropriately regulating a pressure in the sealed tank.

(4) In some embodiments, in the above configuration (3), the acid solution preparation device further includes a pressure sensor for measuring a pressure in the sealed tank. The first valve is configured such that an opening degree thereof is adjusted based on a measurement result by the pressure sensor.

With the above configuration (4), since the opening degree of the first valve is adjusted based on the measurement result of the pressure in the sealed tank, it is possible to regulate the pressure in the sealed tank more appropriately.

(5) In some embodiments, in any one of the above configurations (1) to (4), the purge part includes a purge pipe through which the gas discharged from the sealed tank flows, and a second valve disposed on the purge pipe, for regulating a flow rate of the gas discharged from the sealed tank via the purge pipe.

With the above configuration (5), since the second valve is disposed on the purge pipe for discharging the gas in the sealed tank, by appropriately operating the second valve, it is possible to discharge the gas from the sealed tank while appropriately regulating the pressure in the sealed tank and the gas concentration in gas phase.

(6) In some embodiments, in the above configuration (5), the acid solution preparation device further includes a concentration sensor for measuring an oxygen concentration in gas phase in the sealed tank. The second valve is configured such that an opening degree thereof is adjusted based on a measurement result by the concentration sensor.

With the above configuration (6), since the opening degree of the second valve is adjusted based on the measurement result of the oxygen concentration in the sealed tank, it is possible to discharge the gas from the sealed tank while regulating the oxygen gas concentration in the sealed tank more appropriately.

(7) In some embodiments, in any one of the above configurations (1) to (6), the acid solution preparation device further includes an oxygen gas generating device for generating a gas having a higher oxygen concentration than air. The gas supply part is configured to supply the gas generated by the oxygen gas generating device to the sealed tank as the oxygen-containing gas.

With the above configuration (7), since the oxygen-containing gas having the higher oxygen concentration than air is generated with the oxygen gas generating device, and the oxygen-containing gas is supplied to the sealed tank, it is possible to easily increase the oxygen partial pressure in the sealed tank. Thus, it is possible to easily regulate the dissolved oxygen concentration in the acid solution in the sealed tank.

(8) In some embodiments, in any one of the above configurations (1) to (7), the acid solution preparation device further includes a pressurizing part for pressurizing the oxygen-containing gas supplied to the sealed tank.

With the above configuration (8), since it is possible to pressurize the oxygen-containing gas supplied to the sealed tank by the pressurizing part, it is possible to easily increase the oxygen partial pressure in the sealed tank. Thus, the dissolved oxygen concentration in the acid solution in the sealed tank is regulated easily.

(9) In some embodiments, in any one of the above configurations (1) to (8), the acid solution preparation device further includes a temperature regulating part for regulating a temperature of the acid solution stored in the sealed tank.

With the above configuration (9), since it is possible to regulate the temperature of the acid solution in the sealed tank by the temperature regulating part, it is possible to accelerate an oxidation-reduction reaction of iron ions in the sealed tank. Thus, it is possible to regulate the $Fe^{3+}$ concentration in the acid solution in the sealed tank more efficiently.

(10) In some embodiments, in any one of the above configurations (1) to (9), the acid solution preparation device further includes an acid solution circulation passage for extracting the acid solution stored in the sealed tank and circulating the acid solution to be returned to the sealed tank, and a circulation pump disposed on the acid solution circulation passage.

With the above configuration (10), since the acid solution in the sealed tank is circulated via the acid solution circulation passage and the circulation pump, it is possible to stir the solution in the sealed tank. Thus, it is possible to accelerate dissolution of the oxygen gas into the acid solution in the sealed tank, and to increase the dissolved oxygen concentration in the acid solution. Thus, the oxidation reaction rate of iron ions and the $Fe^{3+}$ concentration in the acid solution in the sealed tank are regulated easily.

(11) In some embodiments, in the above configuration (10), the acid solution circulation passage is configured to circulate the acid solution to be returned to a gas phase portion of the sealed tank, and the acid solution preparation device further comprises an injection part configured to inject, in the gas phase portion, the acid solution returned to the gas phase portion via the acid solution circulation passage.

With the above configuration (11), injecting the acid solution returned from the acid solution circulation passage to the sealed tank in the gas phase portion of the sealed tank, it is possible to form droplets of the acid solution in the gas phase portion. Thus, a contact area between the oxygen-containing gas and the acid solution in the gas phase portion is increased, accelerating dissolution of the oxygen gas into the acid solution. Thus, it is possible to increase the dissolved oxygen concentration in the acid solution, easily regulating the oxidation reaction rate of iron ions and the $Fe^{3+}$ concentration in the acid solution in the sealed tank.

(12) In some embodiments, in the above configuration (10) or (11), the acid solution preparation device further includes a gas mixing part supplied with the acid solution extracted from the sealed tank via the acid solution circulation passage, for mixing the oxygen-containing gas in the supplied acid solution. The acid solution preparation device is configured such that the acid solution from the gas mixing part is stored in the sealed tank.

With the above configuration (12), since the oxygen-containing gas is mixed in the acid solution from the acid solution circulation passage by the gas mixing part, contact between the acid solution and the oxygen-containing gas is enhanced in the gas mixing part, accelerating dissolution of the oxygen gas into the acid solution. Then, since the acid solution of the gas mixing part is returned to the sealed tank, it is possible to increase the dissolved oxygen concentration in the acid solution in the sealed tank more effectively. Thus, the oxidation reaction rate of iron ions and the $Fe^{3+}$ concentration in the acid solution in the sealed tank are regulated easily.

(13) In some embodiments, in the above configuration (12), the gas mixing part is disposed outside the sealed tank.

With the above configuration (13), since the gas mixing part is disposed outside the sealed tank, maintenance of the gas mixing part is easy. For example, removal of parts of the gas mixing part or the like can be performed easily without altering the sealed tank.

(14) In some embodiments, in any one of the above configurations (1) to (13), the acid solution preparation device further includes a gas blowing part for blowing the oxygen-containing gas into the acid solution stored in the sealed tank.

With the above configuration (14), since the oxygen-containing gas is blown into the acid solution in the sealed tank by the gas blowing part, it is possible to form bubbles of the oxygen-containing gas in the acid solution. Thus, the contact area between the acid solution and the oxygen-containing gas is increased, making it possible to accelerate dissolution of the oxygen gas into the acid solution. Thus, it is possible to increase the dissolved oxygen concentration in the acid solution, easily regulating the oxidation reaction rate of iron ions and the $Fe^{3+}$ concentration in the acid solution in the sealed tank.

(14') In some embodiments, in any one of the above configurations (1) to (14), the acid solution preparation device includes at least one of a gas mixing part for mixing the oxygen-containing gas in the acid solution in an acid solution circulation passage for circulating the acid solution in the sealed tank, or a gas blowing part for blowing the oxygen-containing gas into the acid solution stored in the sealed tank. The at least one of the gas mixing part or the gas blowing part is configured to generate fine bubbles of the oxygen-containing gas in the acid solution.

With the above configuration (14'), since the oxygen-containing gas is mixed in the acid solution by the gas mixing part or the oxygen-containing gas is blown into the acid solution by the gas blowing part, it is possible to accelerate dissolution of the oxygen gas into the acid solution. Moreover, since the fine bubbles of the oxygen-containing gas are generated in the acid solution by the gas mixing part or the gas blowing part, it is possible to further accelerate dissolution of the oxygen gas into the acid solution. Thus, it is possible to increase the dissolved oxygen concentration in the acid solution, easily regulating the oxidation reaction rate of iron ions and the $Fe^{3+}$ concentration in the acid solution in the sealed tank.

(14") In some embodiments, in any one of the above configurations (1) to (14), the acid solution preparation device includes at least one of a gas mixing part for mixing the oxygen-containing gas in the acid solution in an acid solution circulation passage for circulating the acid solution in the sealed tank, or a gas blowing part for blowing the oxygen-containing gas into the acid solution stored in the sealed tank. The acid solution preparation device is configured such that the oxygen-containing gas from the gas supply part is supplied to the at least one of the gas mixing part or the gas blowing part without via the gas phase portion in the sealed tank.

With the above configuration (14"), it is possible to supply the oxygen-containing gas of relatively high concentration from the gas supply part to the gas mixing part or the gas blowing part without via the gas phase portion in the sealed tank of relatively low concentration. Thus, it is possible to further accelerate dissolution of the oxygen gas into the acid solution in the gas mixing part or the gas blowing part. Thus, it is possible to increase the dissolved oxygen concentration in the acid solution, easily regulating the oxidation reaction rate of iron ions and the $Fe^{3+}$ concentration in the acid solution in the sealed tank.

(15) In some embodiments, in any one of the above configurations (1) to (14), the acid solution preparation device includes at least one of a gas mixing part for mixing the oxygen-containing gas in the acid solution in an acid solution circulation passage for extracting the acid solution in the sealed tank to the outside of the sealed tank and circulating the acid solution to be returned to the sealed tank, or a gas blowing part for blowing the oxygen-containing gas into the acid solution stored in the sealed tank, and a gas circulation passage for extracting a gas of a gas phase portion in the sealed tank and circulating the gas to be returned to the sealed tank. The acid solution preparation device is configured such that at least one of the gas mixing part or the gas blowing part is supplied with the gas from the gas circulation passage.

With the above configuration (15), since the gas of the gas phase portion in the sealed tank is supplied to the gas mixing part or the gas blowing part while being circulated via the gas circulation passage, it is possible to continuously mix or blow the gas into the acid solution by using the oxygen gas existing in the gas phase portion of the sealed tank. Thus, it is possible to efficiently increase the dissolved oxygen concentration in the acid solution.

(15') In some embodiments, in the above configuration (15), the gas supply part includes a gas supply pipe connected to the gas circulation passage, and is configured to supply the oxygen-containing gas to the sealed tank via the gas circulation passage and the at least one of the gas mixing part or the gas blowing part.

With the above configuration (15'), since the oxygen-containing gas from the gas supply pipe is supplied to the gas mixing part or the gas blowing part via the gas circulation passage, it is possible to simplify the device structure as compared with the case where the oxygen-containing gas from the gas supply pipe is supplied to the gas mixing part or the gas blowing part through a passage different from the gas circulation passage.

(16) In some embodiments, in the above configuration (15), the purge part includes a purge pipe connected to the gas circulation passage, and is configured to discharge the gas in the sealed tank to the outside via the gas circulation passage.

With the above configuration (16), since the purge pipe is connected to the gas circulation passage, it is possible to reduce a connection section between the sealed tank and an external pipe as compared with the case where the purge pipe is connected to the sealed tank. Thus, seal performance of the sealed tank is further improved, making it possible to regulate the oxygen partial pressure in the sealed tank more reliably.

(17) An acid solution supply apparatus according to at least one embodiment of the present invention includes the acid solution preparation device according to any one of the above configurations (1) to (16), an acid solution supply line for supplying the acid solution stored in the sealed tank to a pickling device, a gas recovery container disposed on the acid solution supply line, and a pressure reducing valve disposed upstream of the gas recovery container on the acid solution supply line.

With the above configuration (17), since the gas recovery container and the pressure reducing valve are disposed on the acid solution supply line for supplying the acid solution from the sealed tank to the pickling device, it is possible to reduce the dissolved oxygen concentration in the acid solution by reducing a pressure of the acid solution supply line with the pressure reducing valve. Further, it is possible to store the oxygen gas that cannot be dissolved into the acid solution due to pressure reduction in the gas recovery container. Thus, it is possible to recover residual oxygen contained in the acid solution of the acid solution supply line to effectively be utilized.

(18) A pickling facility according to at least one embodiment of the present invention includes a pickling device for pickling a steel plate with an acid solution, and the acid solution supply apparatus according to the above configuration (17) configured to supply the acid solution to the pickling device.

With the above configuration (18), since it is possible to supply the oxygen-containing gas to the sealed tank, as well as it is possible to discharge the gas in the sealed tank to the outside if the oxygen concentration is decreased by consuming the oxygen-containing gas in the sealed tank, the oxygen gas partial pressure in the sealed tank is regulated easily. That is, since it is possible to regulate a dissolved oxygen concentration in the acid solution in the sealed tank, it is possible to regulate an oxidation reaction rate from ferrous ions ($Fe^{2+}$) to ferric ions ($Fe^{3+}$) in the acid solution in the sealed tank. Thus, it is possible to appropriately regulate the $Fe^{3+}$ concentration in the acid solution in the sealed tank, making it is possible to efficiently pickle the steel plate.

Embodiments of the present invention were described in detail above, but the present invention is not limited thereto, and also includes an embodiment obtained by modifying the above-described embodiments and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "including" or "having" one constitutional element is not an exclusive expression that excludes the presence of other constitutional elements.

REFERENCE SIGNS LIST

1 Pickling facility
2 Steel plate
3 Acid solution
10 Pickling device
12, 12A to 12C Pickling tank
16 Conveyance roll
18 Acid solution supply part
19 Acid solution discharge part
20 Acid solution supply apparatus
22 Acid solution preparation device
23 Pressure reducing valve
24 Acid solution supply line
26 Acid solution return line
27 Gas recovery container
28 Return line
29 Return pump
30 Sealed tank
31 Gas supply part
32 Gas supply pipe
33 Purge part
34 Purge pipe
35 First valve
36 Oxygen gas supply line
37 Second valve
38 Oxygen gas generating device
40 Pressurizing part
42 Acid solution circulation passage
43 Temperature regulating part
44 Circulation pump
46 Gas mixing part
46*a* Gas intake portion
47 Connecting part
48 Injection part
50 Gas circulation passage
52 Gas intake part
52*a* Acid solution intake portion
90 Controller
92 Pressure sensor
94 Concentration sensor
101 Liquid phase portion
102 Gas phase portion
104 Bubble
106 Droplet
107 Liquid phase portion
108 Oxygen gas

The invention claimed is:

1. An acid solution preparation device for preparing an acid solution used for pickling of a steel plate, the device comprising:

a sealed tank for storing the acid solution;

a gas supply part for supplying an oxygen-containing gas from outside of the sealed tank to the sealed tank; and a purge part for discharging a gas in the sealed tank to the outside, wherein the gas supply part includes:

a gas supply pipe through which the oxygen-containing gas supplied to the sealed tank flows; and a first valve disposed on the gas supply pipe, for regulating a pressure of the gas supply pipe.

2. The acid solution preparation device according to claim 1, wherein the gas supply part is configured to supply the oxygen-containing gas having an oxygen partial pressure higher than 0.022 MPa to the sealed tank.

3. The acid solution preparation device according to claim 1, further comprising:

a pressure sensor for measuring a pressure in the sealed tank, wherein the first valve is configured such that an opening degree thereof is adjusted based on a measurement result by the pressure sensor.

4. The acid solution preparation device according to claim 1, further comprising:

an oxygen gas generating device for generating a gas having a higher oxygen concentration than air, wherein the gas supply part is configured to supply the gas generated by the oxygen gas generating device to the sealed tank as the oxygen-containing gas.

5. The acid solution preparation device according to claim 1, further comprising:

a pressurizing part for pressurizing the oxygen-containing gas supplied to the sealed tank.

6. The acid solution preparation device according to claim 1, further comprising:

a temperature regulating part for regulating a temperature of the acid solution stored in the sealed tank.

7. The acid solution preparation device according to claim 1, further comprising:

an acid solution circulation passage for extracting the acid solution stored in the sealed tank and circulating the acid solution to be returned to the sealed tank; and a circulation pump disposed on the acid solution circulation passage.

8. The acid solution preparation device according to claim 7, wherein the acid solution circulation passage is configured to circulate the acid solution to be returned to a gas phase portion of the sealed tank, and wherein the acid solution preparation device further comprises an injection part configured to inject, in the gas phase portion, the acid solution returned to the gas phase portion via the acid solution circulation passage.

9. The acid solution preparation device according to claim 7, further comprising:

a gas mixing part supplied with the acid solution extracted from the sealed tank via the acid solution circulation passage, for mixing the oxygen-containing gas in the supplied acid solution, wherein the acid solution preparation device is configured such that the acid solution from the gas mixing part is stored in the sealed tank.

10. The acid solution preparation device according to claim 9, wherein the gas mixing part is disposed outside the sealed tank.

11. The acid solution preparation device according to claim 1, further comprising:

a gas blowing part for blowing the oxygen-containing gas into the acid solution stored in the sealed tank.

12. The acid solution preparation device according to claim 1, further comprising:

at least one of a gas mixing part for mixing the oxygen-containing gas in the acid solution in an acid solution circulation passage for extracting the acid solution in the sealed tank to the outside of the sealed tank and circulating the acid solution to be returned to the sealed tank, or a gas blowing part for blowing the oxygen-containing gas into the acid solution stored in the sealed tank; and a gas circulation passage for extracting a gas of a gas phase portion in the sealed tank and circulating the gas to be returned to the sealed tank, wherein the acid solution preparation device is configured such that at least one of the gas mixing part or the gas blowing part is supplied with the gas from the gas circulation passage.

13. The acid solution preparation device according to claim 12, wherein the purge part includes a purge pipe connected to the gas circulation passage, and is configured to discharge the gas in the sealed tank to the outside via the gas circulation passage.

14. An acid solution supply apparatus, comprising:

the acid solution preparation device according to claim 1;

an acid solution supply line for supplying the acid solution stored in the sealed tank to a pickling device;

a gas recovery container disposed on the acid solution supply line; and a pressure reducing valve disposed upstream of the gas recovery container on the acid solution supply line.

15. A pickling facility, comprising:

a pickling device for pickling a steel plate with an acid solution; and the acid solution supply apparatus according to claim 14 configured to supply the acid solution to the pickling device.

16. An acid solution preparation device for preparing an acid solution used for pickling of a steel plate, the device comprising:

a sealed tank for storing the acid solution;

a gas supply part for supplying an oxygen-containing gas from outside of the sealed tank to the sealed tank; and a purge part for discharging a gas in the sealed tank to the outside, wherein the purge part includes:

a purge pipe through which the gas discharged from the sealed tank flows; and a valve disposed on the purge pipe, for regulating a flow rate of the gas discharged from the sealed tank via the purge pipe.

17. The acid solution preparation device according to claim 16, further comprising:

a concentration sensor for measuring an oxygen concentration in gas phase in the sealed tank, wherein the valve is configured such that an opening degree thereof is adjusted based on a measurement result by the concentration sensor.

18. An acid solution supply apparatus, comprising:

the acid solution preparation device according to claim 5;

an acid solution supply line for supplying the acid solution stored in the sealed tank to a pickling device;

a gas recovery container disposed on the acid solution supply line; and a pressure reducing valve disposed upstream of the gas recovery container on the acid solution supply line.

19. A pickling facility, comprising:

a pickling device for pickling a steel plate with an acid solution; and the acid solution supply apparatus according to claim 18 configured to supply the acid solution to the pickling device.

* * * * *